US008220962B2

(12) United States Patent
Cheng

(10) Patent No.: US 8,220,962 B2
(45) Date of Patent: Jul. 17, 2012

(54) REFLECTOR PANEL OF AN LED STREET LAMP

(75) Inventor: Shiyou Cheng, Huzhou (CN)

(73) Assignee: Zhejiang Jingri Lighting Technology Co., Ltd., Huzhou, Zhejiang Province (CN)

( * ) Notice: Subject to any disclaimer, the term of this patent is extended or adjusted under 35 U.S.C. 154(b) by 343 days.

(21) Appl. No.: 12/617,604

(22) Filed: Nov. 12, 2009

(65) Prior Publication Data

US 2010/0165641 A1 Jul. 1, 2010

(30) Foreign Application Priority Data

Dec. 29, 2008 (CN) ..... 2008 1 0306628

(51) Int. Cl.
*F21V 21/00* (2006.01)

(52) U.S. Cl. ..... 362/249.02; 362/227; 362/235; 362/236; 362/237; 362/238; 362/239; 362/240; 362/241; 362/242; 362/243; 362/244; 362/245; 362/246; 362/247; 362/248; 362/249.01

(58) Field of Classification Search ..... 362/800, 362/227, 235–249.02
See application file for complete search history.

(56) References Cited

U.S. PATENT DOCUMENTS

2009/0257224 A1* 10/2009 Huang et al. ..... 362/235
2010/0027274 A1* 2/2010 Liu et al. ..... 362/346

* cited by examiner

*Primary Examiner* — William Carter
(74) *Attorney, Agent, or Firm* — Olive Law Group, PLLC

(57) ABSTRACT

The present invention relates to the technical field of LED street lamp, in particular to structure of a reflector panel of the LED lamp. A reflector panel comprises a base, the base has multiple reflector cups, which are divided into two groups according to the direction of their openings, all reflector cups in each group have the same direction of their openings, the directions of the openings of the reflector cups in two different groups are opposite. The reflector panel of the present invention can form the illumination band with even illuminance on the street and cause small light loss.

6 Claims, 6 Drawing Sheets

REFLECTOR PANEL OF AN LED STREET LAMP

TECHNICAL FIELD

The present invention relates to a LED street lamp, in particular to a reflector panel thereof.

BACKGROUND ART

The high power LED (it means that the power of a single LED is not less than 1 W) lighting is a revolutionary technology that is currently recognized all over the world and can substitute the traditional lighting. The high power LED lamps can be used as the substitute of the currently used high power street lamps and flood lights.

The LED used as the street lamp results in that the light emitted on the street is dark or the utilization rate of the light is lower since the LED particle's angle of illumination is small and the light's irradiating face is not even. The optimum illumination zone of the street lamp is a rectangular light area, the long edge of which coincides with the street direction and the short edge of which coincides with the street width. The illumination zone of the LED street lamps with condensing lens currently used is a circular area, the two illumination zones formed by the two adjacent street lamps cannot join resulting in multiple dark areas in the street, which largely decrease the evenness index; whereas along the width direction of the street, two edges of the circular light area have many invalid illumination zones, which are wasteful.

CONTENTS OF THE INVENTION

The present invention is to provide a reflector panel of a LED street lamp, which can improve the street illumination uniformity and utilization rate of light.

The above-mentioned purpose of the present invention is realized through the following technical scheme:

A reflector panel of a LED street lamp, comprising a base plate, the said base plate has multiple reflector cups, the said reflector cups are divided into two groups according to the direction of their openings, one of which with the direction of all cup openings the same and the other of which with the direction opposite to the street direction.

The present invention of the reflector panel of the LED street lamp is used to re-distribute the light emitted from the LED street lamp, the street lamp consisting of multiple light emitting diodes emit the light reflected by multiple reflector cups respectively towards two directions of the street.

As the preference, the multiple reflector cups are arranged in rectangular manner on the base plate, so the entire illumination zone of the LED street lamp is a rectangle that can match with the shape of the street and improve the utilization rate of the light.

To realize the purpose of the present invention, the said base plate can be integrated with the reflector cup; or the reflector cup can be connected to the base plate separately made. The connection of integral type needs no assembly, and no fixed connection part is required between the base plate and the reflector cup, so the cost is comparatively low. However, since the reflecting surface of the reflector cup needs the surface treatment, if the base plate and the reflector cup are of separate connection type, the reflecting surface of the reflector cup can be treated separately and the process of this treatment is comparatively simple. In addition, once any reflector cup has defect, it can be replaced directly instead of replacing the entire reflector panel. Therefore, the preference of the present invention is the separately connected reflector cup and base plate.

As the further preference of the above-mentioned scheme, the said base plate has multiple base holes for holding the reflector cups, with the reflector cups locked in the base holes.

As the preference of the present invention, the said reflector cup consists of top, bottom and the reflecting part between the top and bottom. The reflector cup has top and bottom, both of which are mouth-like end face, inside the top there is a space for mounting the light emitting diode, the opening of the bottom is generally lager than the top's opening, the reflecting part of the bottom reflects the light emitted from the light emitting diode inside the top to the ground under the lamp.

The LED street lamps, comprised by the base plates, are mounted at two sides of the street, the said street direction refers to the direction, which is determined according to the positional relationship between the base plate and the street after the base plate has been mounted at the LED street lamp for actual use. Along the street direction, directions of the openings of the two groups of reflector cups are different, thus these two groups of reflector cups can emit light towards front and back directions along the street direction. The LED street lamps are mounted along the street direction one by one with certain interval kept between two adjacent LED street lamps, the zone between the two adjacent LED street lamps are illuminated by the two groups of light emitting diodes of these two LED street lamps, the two groups of light emitting diodes respectively belong to the two adjacent LED street lamps. Technicians of this field can understand that the bottom of the reflector cup is the opening of the reflector cup, while the connecting direction of the connecting part between the top and bottom of the reflector cup is the said direction of opening of the present invention.

Since the light emitting diode has defects like short emitting range and serious scattering, and the illumination effect of the street lamp is required to be local illumination, that is to say, the street lamp is only required to illuminate the street surface, if the light is directly emitted to other zones and thereby results in decrease of the efficiency. The reflector cup of the present invention collects the diverging light emitting from the light emitting diode and project it on the street surface, meanwhile, the reflector cups are divided into two groups, which form two opposite projections along the street direction and consequently from an illumination band with LED street lamps distributed on the street surface in a concentrated way. Thus, only few light is wasted on the non-street-surface area.

The present invention using the rectangular bottom of the reflector cup makes each reflector cup's illumination zone form a rectangular illumination band, which meets the shape features of the street and can decrease the light waste to the most extent. Meanwhile, the uniform divergence and distribution of the light is guaranteed.

Since in the present invention, multiple light emitting diodes are adopted to compose a LED street lamp, and multiple illumination bands formed by multiple light emitting diodes are overlapped forming a bright illumination band of the LED street lamp. As has been said before, the illumination band only covers the street direction and no light is wasted in other areas. Meanwhile, since the opening is made in rectangular shape forming a rectangular illumination belt, not only the shape of the illumination belt meets the shape features of the street, but also the illumination band between two adjacent street lamps can decrease the overlapping and darkness as much as possible, meanwhile the illumination of the illumination band is uniform everywhere. The present invention also needs to adjust the illumination of the illumination band to ensure the uniformity. In order to reach this purpose, the reflecting part has four faces of inner transverse face, outer transverse face, inner vertical face and outer vertical face, the said outer transverse face and outer vertical face are planes, while the said inner vertical face and inner transverse face are curved surfaces.

When the reflector cup works, the names of these four faces shall be understood. At this point, the LED street lamp is supported by the lamp post and suspended above one side of the street, the reflector cups are mounted on the base plate. For each reflector cup, the face which is close to the lamp post and parallel to the street direction is the inner vertical face, the face which is far away from the lamp post and parallel to the street direction is the outer vertical face, the face which is close to the lamp post and perpendicular to the street direction is the inner transverse face, the face which is far away from the lamp post and perpendicular to the street direction is the outer transverse face.

As the preference of the above-mentioned scheme, the said inner transverse face is a paraboloid, and the said inner vertical face is a cylindrical face. The preferential scheme can realize uniform illumination of the illumination band and good degree of uniformity.

As the further preference of the above-mentioned scheme, the included angle between the outer transverse face and the base plate is within 25~45°, and between the inner transverse face and the base plate is within 70~90°.

Since the said faces may be curved surfaces, it is necessary to define in detail the said included angles of the present invention herein. The said included angel refers to the angle include between the connecting line from corresponding point at the reflector cup's top to another corresponding point at the bottom of the face and the base plate plane. In order to better control the distribution of the light along the street width, the included angle between the outer vertical face and the base plate is within 57~70°, and the included angle between the inner vertical face and the base plate is within 95~110°.

Based on the height of the lamp post commonly used on the street and the width of the street, the height of the said reflector cup is within 0.5~1.5 mm in order to better control the conformity of the illumination of the illumination band. Once the height matches with each face, the reflector cup can create a more excellent even illumination band.

In order to make the reflector cup more stably mounted on the base plate, the base holes on the said base plate of the present invention are used for holding the reflector cups, and the bottom of each reflector cup has a stop frame for stopping the reflector cup from exceeding the required position.

As the preference of the present invention, the back of the said reflector cup has a buckle, and the back of the said base plate has a slot matching the buckle.

Through the said buckle, the reflector cup can easily be mounted in the base plate, and the installation and dismantle are simple.

Generally, the said products of the present invention are plastic parts, and there is allowance left when designing the buckle and slot so as to avoid that the buckle could not be inserted in the slot, which, however, results in that the possibility of the relative move between the reflector cup and the base plate increases, which may cause the comparatively deviation between the light reflected by the reflector cup and the design. In order to solve this problem, there are multiple convex ribs along the radial direction of the edge of the base hole, that is, the convex ribs are mounted at the lip of the base hole towards the interior, and the convex rib can decrease the movement of the reflector cup. When there are sufficient convex ribs mounted along the lip of the base hole, the reflector cup almost will not move.

As the preference of the present invention, the back of the outer transverse face of the reflector cup has a buckling strip.

Since the included angel between the outer transverse face of the present invention and the base plate is comparatively small, the move can happen more easily compared with the base plate, the buckling strip at the back of the reflector cup can match with the peristome of the base hole to avoid movement. When the convex ribs are mounted at the peristome of the base hole, it can directly match with the buckling strip to more effectively avoid the movement of reflector cup.

As the preference of the present invention, the said buckle has a reinforcing rib.

Through a series of optimized mechanical designs that are mentioned above, the present invention can better make the reflector cup stably and accurately be mounted on the base plate to ensure the reflecting effect of the reflector cup.

As the preference of the above-mentioned scheme, the multiple same reflector cups form the reflector cup module group and there are base holes on the base plate that correspond to the above-mentioned module group. Thus, the reflector cup can be more conveniently installed and dismantled in groups.

In a word, the present invention has the following advantages:

1. In the present invention, two groups of reflector cups with different light directions are mounted on a base plate and the shape of the reflector cup is optimized to ensure that the illumination of the illumination band formed by each reflector cup is even, meanwhile the shape of the reflector cup is optimized taking into consideration the shape features of the street.

2. In the present invention, the reflecting part of the reflector cup is optimized, the four-face construction is adopted, and the shape of each face is optimized in order to create the illumination band with more even illumination, meanwhile, the overlapping of multiple illumination bands are smooth and the darkness and light concentrating phenomena occurring within the area between two adjacent illumination bands decrease.

3. In the present invention, a series of preferential measures are taken, such as the buckle is mounted at the back of the reflector cup, the reinforcing rib is mounted along the edge of the base hole, which ensure the stable and accurate position of the reflector cup and the reflecting efficiency of the reflector cup.

MODE OF CARRYING OUT THE INVENTION

Figure 1:
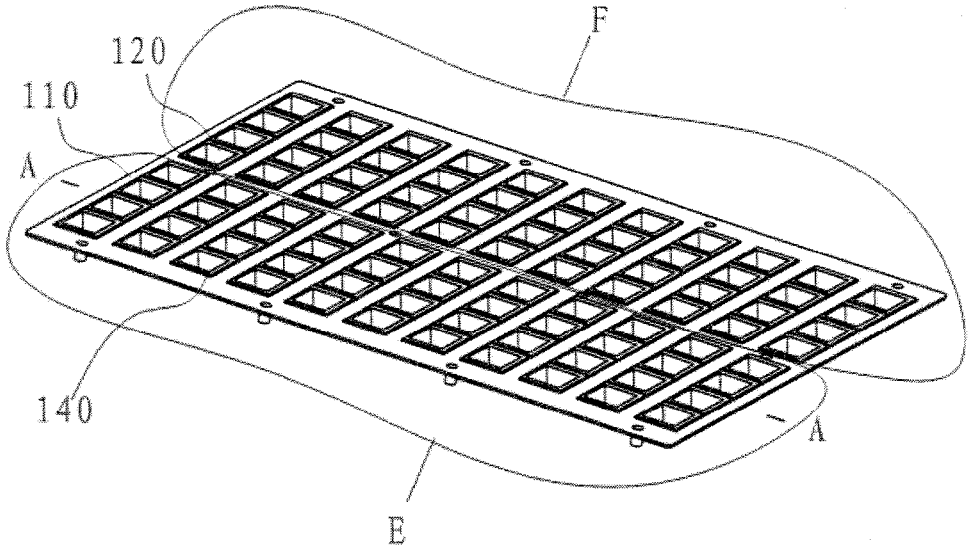
FIG. 1 shows the overall structure schematic diagram of front face of LED street lamp's reflector cup in embodiment 1 of the present invention.
Figure 2:
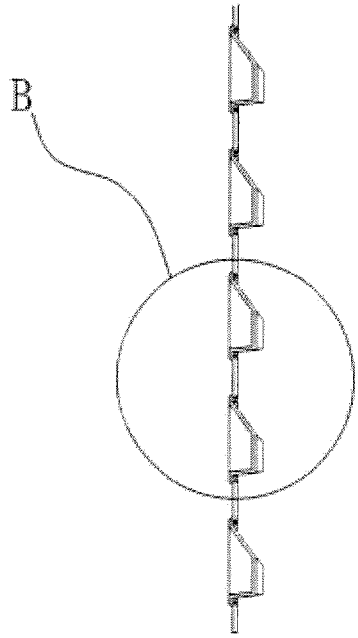
FIG. 2 shows the sectional view of A-A direction in FIG. 1.
Figure 3:
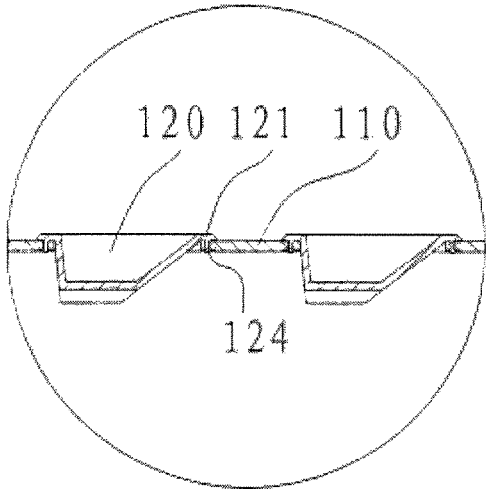
FIG. 3 shows the enlarged drawing of Part B in FIG. 2.
Figure 4:
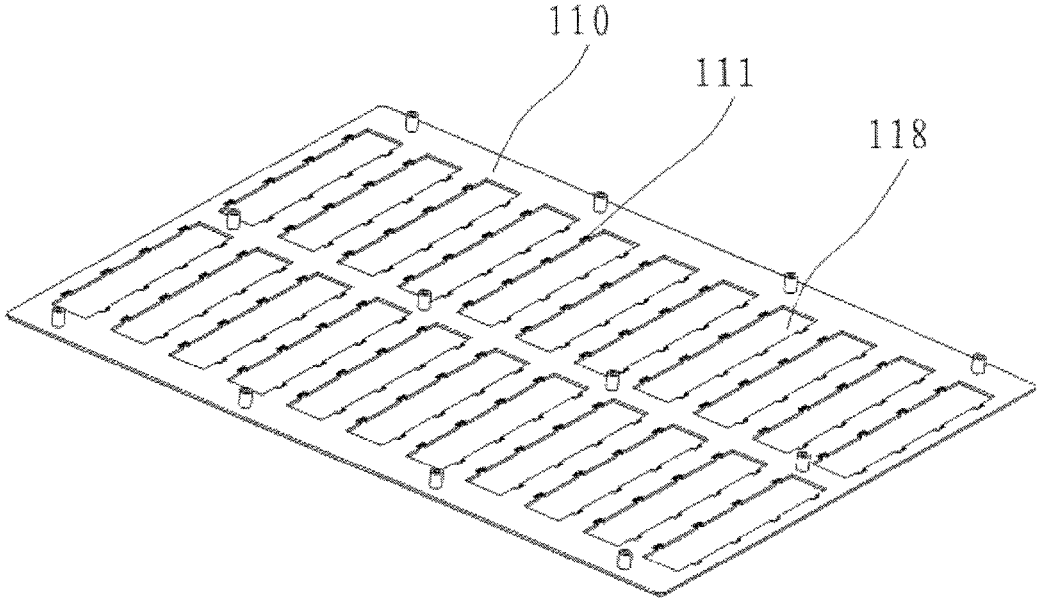
FIG. 4 shows the structural schematic diagram of back of base plate in embodiment 1.
Figure 5:
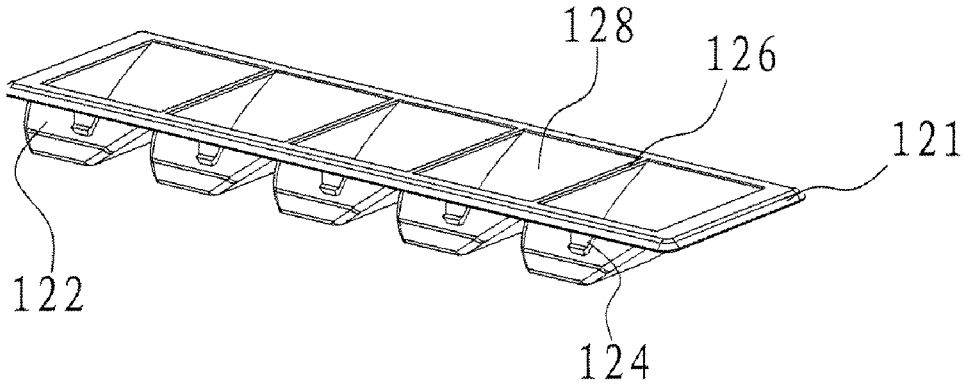
FIG. 5 shows the structural schematic diagram of reflector cup module group at left opening direction in embodiment 1.
Figure 6:
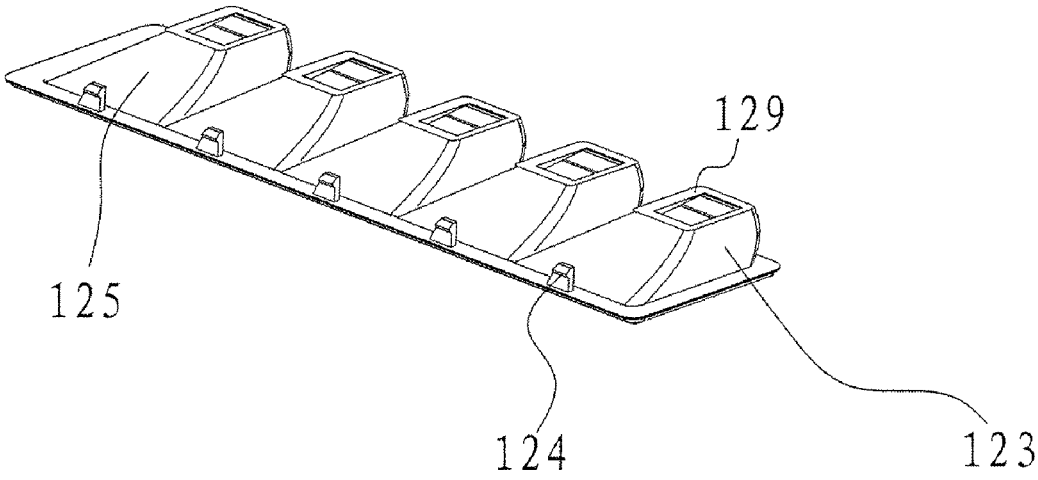
FIG. 6 shows the structural schematic diagram of reflector cup module group at right opening direction in embodiment 1.
Figure 7:
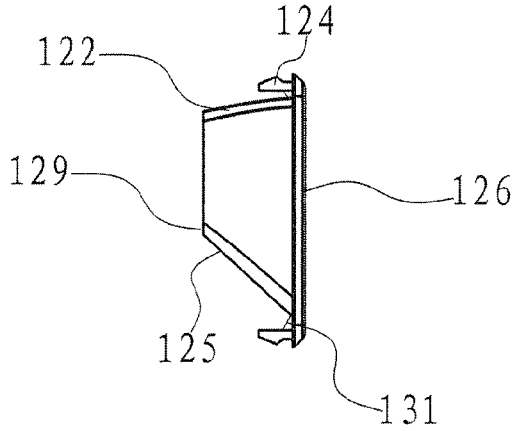
FIG. 7 shows the prospective view of side of reflector module group in embodiment 1.
Figure 8:
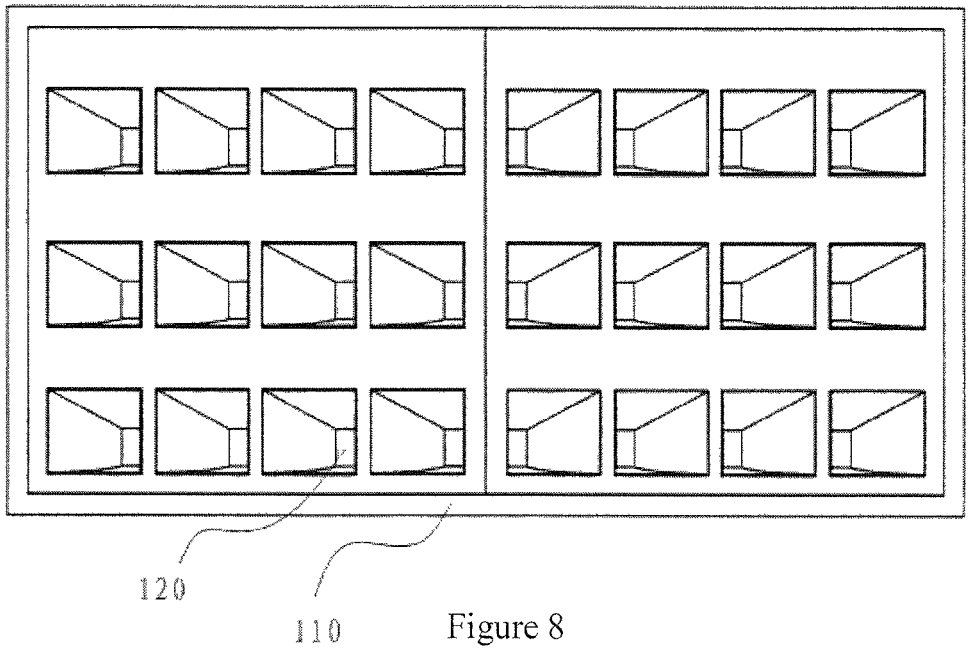
FIG. 8 shows the structural schematic diagram of reflecting face of reflector panel in embodiment 2.
Figure 13:
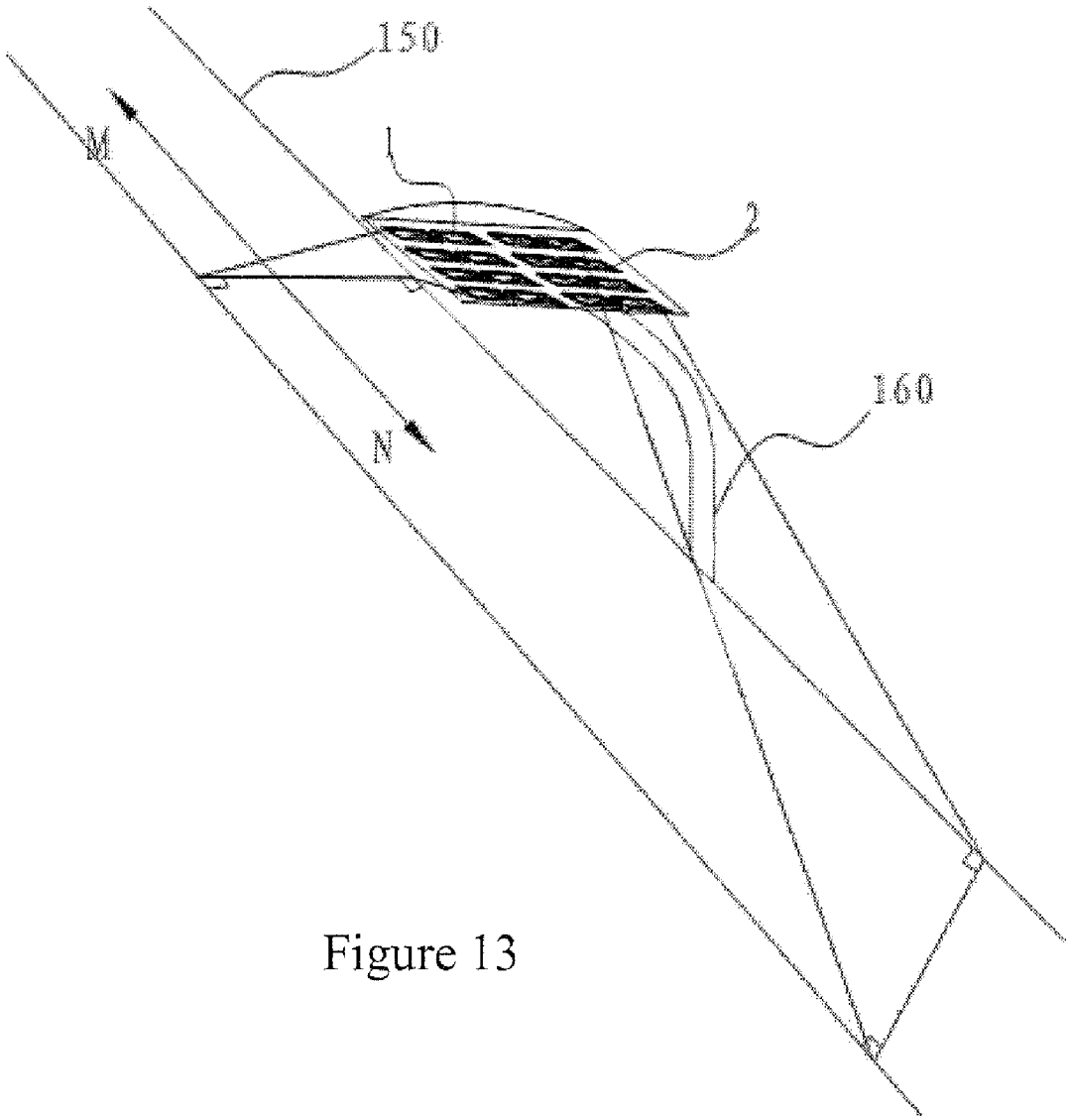
FIG. 13 shows the schematic diagram of LED street lamp with reflector cup mounted on the street.

Embodiment 1: as shown in FIG. 1-7, a reflector cup of a LED street lamp, comprising base plate 110, the base plate 110 is divided into two parts that are distributed symmetrically. As shown in the figure, the left part E is introduced in detailed herein. In the left part E, there are 11 parallel base holes 118, and in each base hole 118 there are a reflector cup module group 140 with opening towards left direction, as shown in FIGS. 5, 6 and 7, the reflector cup module group 140 consists of 4 reflector cups 120 that are distributed side by side. The openings of the reflector cups 120 in the reflector cup module group 140 in left part E also is towards the left, each reflector cup 120 covers a light emitting diode, the light from the light emitting diode is emitted along the opening direction of the reflector cup after it is reflected by the reflecting face of the reflector cup. Correspondingly, the openings of all reflector cups in right part F points to right direction. Therefore, the light emitted from the left and right parts of the base plate 110 respectively is emitted towards left and right. FIG. 13 shows the situation where the LED street lamp made by base plate 110 is installed in the street, in which the M-N direction is the street direction, the reflector cup group 1 and the reflector cup group 2 respectively emit light to opposite directions, the reflector cup group 1 emits light to M direction while the reflector cup group 2 emits light to N direction. Thus, one LED street lamp can illuminate its two sides with same distance along the street direction and the intensities of the illumination of the two sides are the same.

Figure 9:
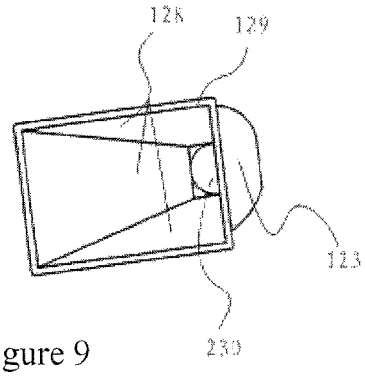
FIG. 9 shows the structural schematic diagram of reflector cup with light emitting diode mounted at left opening direction in embodiment 2.
Figure 11:
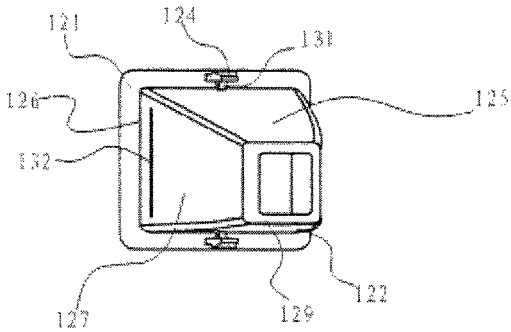
FIG. 11 shows the structural schematic diagram of back of reflector cup in FIG. 9.
Figure 10:
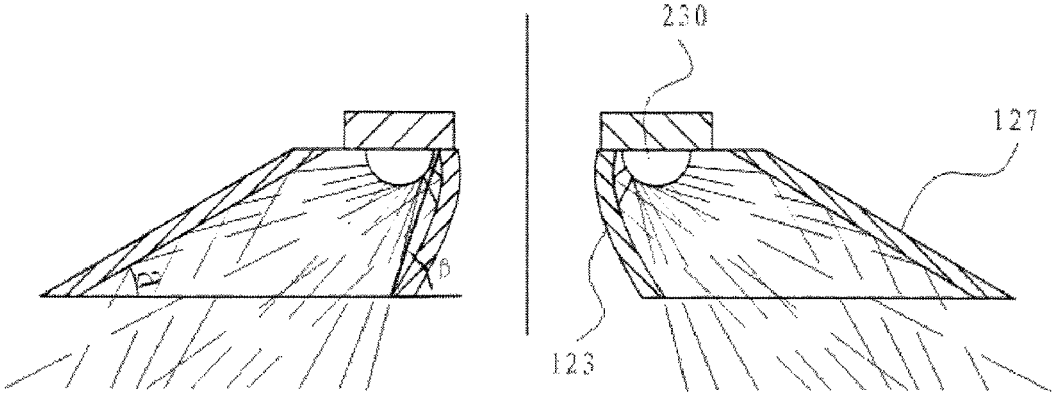
FIG. 10 shows the light reflection effect drawing of vertical sectional view of light emitting diode in reflector cup in embodiment 2, the two reflector cups with different opening directions reflect the light towards opposite directions along the street direction.
Figure 12:
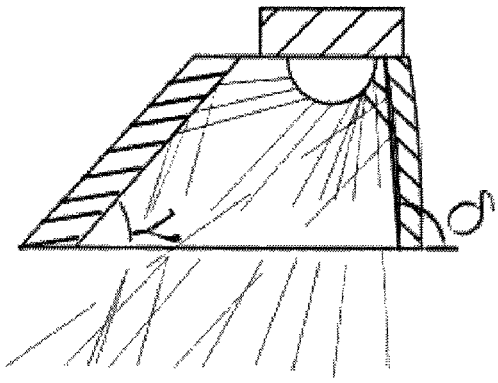
FIG. 12 shows the light reflection effect drawing of vertical sectional view of two reflector cups at left and right opening directions in embodiment 2.

As shown in FIG. 11, there is a stop frame 121 mounted at the bottom 126 of the reflector cup 120 with left opening for stopping the reflector cup 120 from exceeding the required position in the base hole 118. The reflector cup 120 has a reflecting face 128 and a back, the reflecting face 128 is used for reflecting the light emitted from the light emitting diode and a buckle 124 is mounted at the back of the reflector cup 120, the said buckle 124 is an elastic buckle that fixes the reflector cup 120 in the base hole 118. A reflector cup 120 includes a top 129 with a square peristome, a bottom 126 with a square peristome and a reflecting part connecting the top 129 and the bottom 126. As shown in FIGS. 9 and 11, in the reflector cup 120 of left opening, the reflecting part comprise an inner transverse face 123, an outer transverse face 127, an inner vertical face 122 and an outer vertical face 125, the outer transverse face 127 and the outer vertical face 125 are planes, the inner vertical face 122 and the inner transverse face 123 are curved surfaces. The said inner transverse face 123 is a paraboloid; the said inner vertical face 122 is a cylindrical face. The distance between the top 129 and bottom 126 of the reflector cup is 1 cm. As shown in FIGS. 10 and 12, the included angel $\alpha$ between the outer transverse face 127 and the base plate is within 25~45°, the preference of which is within 25~30°, the included angel $\beta$ between the inner transverse face and the base plate is within 70~90°; The included angle $\gamma$ between the outer vertical face 125 and the base plate 110 is within 50~70°, and the included angel $\beta$ between the said inner vertical face 122 and the base plate 110 is within 95~110°.

As shown in FIGS. 4 and 9, the back of the base plate 110 has a slot matching the buckle 124, the back of the buckle 124 has a reinforcing rib 131; the back of the outer transverse face 127 of the said reflector cup 120 has a buckling strip 132.

Embodiment 2: As shown in FIGS. 8~13, a reflector panel of the LED street lamp, comprising two parts, each of which has 12 base holes. The base hole is for holding the reflector cup 120, and the opening direction of the reflector cups 120 in these two parts is different, the middle line between two parts is perpendicular to the street direction, the reflector cups 120 in the two parts reflect the light emitted from the light emitting diodes respectively towards the front and back directions along the street direction. FIG. 10 is a sectional view of the reflector cup 120 along the street direction, which shows the track of the reflected light along the street direction by the reflector cups, as shown in this the inner transverse face 123 and the outer transverse face 127 on the street, the said two faces control the length and evenness of the illumination band formed by the reflector cups along the street direction.

This figure also shows that these two faces can evenly distribute the light, emitted from the light emitting diodes 230, along the street direction. Meanwhile, the light emitted from the light emitting diode can directly cover the area above the lamp, and the overlapping of illumination bands formed by multiple reflector cups can achieve the required intensity of illumination, the two adjacent street lamps are not overlapped which causes no darkness and realizing the joining of two adjacent illumination bands and therefore ensures that there is no darkness and overlapping between the two adjacent illumination bands. As shown in FIG. 11, the reflector cup 120 with right opening has a buckle 124 at the back of its outer transverse face 127, and the bottom 129 of the reflector cup 120 has a stop frame 121. A buckle 124 is mounted at the back of the reflector cup 120, the said buckle 124 is an elastic buckle that fixes the reflector cup 120 in the base hole 118. A reflector cup 120 includes a top 129 with a square peristome, a bottom 126 with a square peristome and a reflecting part connecting the top 129 and the bottom 126.

As shown in FIG. 13, the reflector panel is used for LED street lamp, there are two groups of reflector cups mounted on the reflector panel, which are the reflector cup group 1 and the reflector cup group 2, the openings of which respectively point to the M-direction and the N-direction, the lamp post 160 is installed at one side of the street 150, the LED street lamp forms a even and strip-like illumination band on the street 150, which is created by eight beams of lights reflected by eight reflector cups. These lights integrate with each other forming a illumination band with even illuminance and the light emitted to the non-street area is almost eliminated.

The remaining parts of this embodiment are same with the embodiment 1.

Attention shall be paid to that since the single reflector cup in this embodiment is basically same with the single reflector in embodiment 1 in structure, the embodiment 1 explains the structure of the reflector cup in embodiment 1 combining with FIGS. 9~13.

The invention claimed is:

1. A reflector panel of an LED street lamp comprising:

a base plate having multiple reflector cups, wherein the reflector cups are divided into two groups according to the direction of their openings, one of which the direction of all cup openings is the same and the other of which the direction is opposite to the street direction, wherein the reflector cup comprises a top, a bottom, and a reflector part that connects the top and bottom, the reflector part consisting of a curved parabolic planar inner transverse face, a planar outer transverse face, a cylindrical inner vertical face, and an outer vertical face.

2. The reflector panel of claim 1, wherein the base plate has multiple base holes configured for supporting the reflector cups, the bottom of each reflector cup having a stop frame for stopping the reflector cup from extending beyond a desired position.

3. The reflector panel of claim 2, wherein the back of the reflector cup includes a buckle, the back of the base plate defines a slot matching the buckle, and the buckle includes a reinforcing rib.

4. The reflector panel of claim 3, further comprising multiple convex ribs along the radial direction of the edge of the base hole.

5. The reflector panel of claim 4, wherein the back of the outer transverse face of the reflector cup includes a buckling strip.

6. The reflector panel of claim 1, wherein the angle between the outer transverse face and the base plate is between about 25 and about 45 degrees, the angle between the inner transverse face and the base plate is between about 70 and about 90 degrees, the angle between the outer vertical face and the base plate is between about 50 and about 70 degrees, and the angle between the inner vertical face and the base plate is between about 95 and about 110 degrees.

* * * * *